US009651900B2

(12) United States Patent
Shibasaki

(10) Patent No.: US 9,651,900 B2
(45) Date of Patent: May 16, 2017

(54) IMAGE FORMATION APPARATUS AND INFORMATION PROCESSING DEVICE FOR CORRECTING COLOR MISREGISTRATION

(71) Applicant: Oki Data Corporation, Tokyo (JP)

(72) Inventor: Jumpei Shibasaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/186,874

(22) Filed: Jun. 20, 2016

(65) Prior Publication Data

US 2017/0023888 A1 Jan. 26, 2017

(30) Foreign Application Priority Data

Jul. 21, 2015 (JP) ..... 2015-144045

(51) Int. Cl.
*G03G 15/01* (2006.01)
*G03G 15/16* (2006.01)
*G03G 15/00* (2006.01)

(52) U.S. Cl.
CPC ..... *G03G 15/1615* (2013.01); *G03G 15/01* (2013.01); *G03G 15/5058* (2013.01); *G03G 2215/0129* (2013.01); *G03G 2215/0161* (2013.01)

(58) Field of Classification Search
CPC ..... G03G 15/01; G03G 15/0131; G03G 15/0189; G03G 15/0194; G03G 15/5058
USPC ..... 399/49, 301
See application file for complete search history.

(56) References Cited

U.S. PATENT DOCUMENTS 8,036,552 B2 * 10/2011 Hashimoto ..... G03G 15/0131 399/301
8,995,892 B2 * 3/2015 Sato ..... G03G 15/01 399/301

FOREIGN PATENT DOCUMENTS

JP 2013-120215 A 6/2013

* cited by examiner

*Primary Examiner* — William J Royer
(74) *Attorney, Agent, or Firm* — Mots Law, PLLC

(57) ABSTRACT

An image formation apparatus includes: image formation units mounted in series in a conveyance direction of a transfer object and that form images and correction patterns of different color developers on the transfer object; a sensor that detects a color misregistration, by the emission of a detection light to the correction pattern on the transfer object and the reception of a reflection light from the transfer object; an identification unit that identifies, out of the image formation units, a first image formation unit using a first developer which is the developer with the lowest reflectance, based on reflectance information indicating reflectances of the developers for the image formation units, or based on color information indicating the colors of the developers for the image formation units; and a corrector that corrects the color misregistration with respect to the first image formation unit identified by the identification unit.

13 Claims, 12 Drawing Sheets

FIG. 3

310Y, 310M, 310C, 310K, 310W

| BIT | NAME | DESCRIPTION |
|---|---|---|
| 3:0 | T_R | REFLECTION LEVEL OF TONER (1 TO 7) |

| TONER | VALUE |
|---|---|
| Y (30Y) | 0x4 |
| M (30M) | 0x4 |
| C (30C) | 0x4 |
| K (30K) | 0x1 |
| W (30W) | 0x5 |

61 REFLECTANCE INFORMATION

FIG. 4

330

| BIT | NAME | DESCRIPTION |
|---|---|---|
| 7:4 | D_R | DIFFUSE REFLECTION LEVEL OF BELT (1 TO 7) |
| 3:0 | M_R | SPECULAR REFLECTION LEVEL OF BELT (1 TO 7) |

| BELT | VALUE |
|---|---|
| RESIN BELT (33) | 0x17 |

62 REFLECTANCE INFORMATION

FIG. 5

64 SETTING TABLE

| DETECTION OBJECT | MAXIMUM REFLECTION LEVEL | EMISSION CURRENT (mA) | |
|---|---|---|---|
| DIFFUSE REFLECTION LIGHT (Lrd) | 0.5≦, <1.5 | 27.5 | Id |
| | 1.5≦, <2.5 | 25.0 | |
| | 2.5≦, <3.5 | 22.5 | |
| | 3.5≦, <4.5 | 20.0 | |
| | 4.5≦ | 15.0 | |
| SPECULAR REFLECTION LIGHT (Lrm) | 0.5≦, <3.0 | 8.5 | Im |
| | 3.0≦, <5.0 | 8.0 | |
| | 5.0≦, <6.5 | 7.0 | |
| | 6.5≦, <7.0 | 6.5 | |
| | 7.0≦ | 5.0 | |

FIG. 6

| DETECTION OBJECT | DYNAMIC RANGE LOWER LIMIT Th |
|---|---|
| DIFFUSE REFLECTION LIGHT (Lrd) | 0.5 |
| SPECULAR REFLECTION LIGHT (Lrm) | 0.5 |

FIG. 8A

| IMAGE DRUM UNIT | 31Y | 31M | 31C | 31K | 31W |
|---|---|---|---|---|---|
| COLOR OF TONER | Y (30Y) | M (30M) | C (30C) | K (30K) | W (30W) |
| REFLECTION LEVEL OF TONER | 4 | 4 | 4 | 1 | 5 |
| DIFFUSE REFLECTION LEVEL OF BELT | 1 | | | | |
| SPECULAR REFLECTION LEVEL OF BELT | 7 | | | | |

FIG. 8B

| | | | | | | |
|---|---|---|---|---|---|---|
| Lrd | MAXIMUM REFLECTION LEVEL | 2.5 | 2.5 | 2.5 | — | — |
| | MINIMUM REFLECTION LEVEL | 1.0 | 1.0 | 1.0 | — | — |
| Lrm | MAXIMUM REFLECTION LEVEL | — | — | — | — | 6 |
| | MINIMUM REFLECTION LEVEL | — | — | — | — | 3 |
| Lrd | DYNAMIC RANGE | 1.5 | 1.5 | 1.5 | — | — |
| Lrm | DYNAMIC RANGE | — | — | — | — | 3 |

FIG. 12

310Y, 310M, 310C, 310K, 310W

63 COLOR INFORMATION

| BIT | NAME | DESCRIPTION |
|---|---|---|
| 3:0 | T_Col | (0:K, 1:Y, 2:M, 3:C, 4:W, 5~15:Reserve) |

FIG. 13

64A SETTING TABLE

| COLOR OF REFERENCE TONER | EMISSION CURRENT (mA) | |
|---|---|---|
| | UPSTREAM SIDE (Lrd) | DOWNSTREAM SIDE (Lrm) |
| K | 22.5 | 7.0 |
| Y, M, C, W | 22.0 | 7.0 |
| | Id | Im |

IMAGE FORMATION APPARATUS AND INFORMATION PROCESSING DEVICE FOR CORRECTING COLOR MISREGISTRATION

CROSS REFERENCE TO RELATED APPLICATIONS

This application claims priority based on 35 USC 119 from prior Japanese Patent Application No. JP2015-144045 filed on Jul. 21, 2013, entitled "IMAGE FORMATION APPARATUS AND INFORMATION PROCESSING DEVICE", the entire contents of which are incorporated herein by reference.

BACKGROUND OF THE INVENTION

1. Field of the Invention

This disclosure relates to an information processing device that performs a predetermined information processing and an image formation apparatus that includes the information processing device.

2. Description of Related Art

In an image formation apparatus, an image is formed, for instance, on a print medium such as a paper sheet, and subsequently, fixing and paper ejection are performed (see, for instance, Japanese Patent Application Publication No. 2013-120215).

SUMMARY OF THE INVENTION

It is desirable to improve the convenience of an image formation apparatus.

An object of an embodiment of the invention is to provide an image formation apparatus and an information processing device that are capable of improving convenience.

A first aspect of the invention provides an image formation apparatus that includes: image formation units that are mounted in series in a conveyance direction of a transfer object, and that form developer images of respectively different colors and correction patterns of the different colors on the transfer object by using developers with the different colors; a sensor that detects a color misregistration, which is a variation in the formation position of the developer image on the transfer object between the colors, by utilizing the emission of a detection light to the correction pattern on the transfer object and the reception of a reflection light from the transfer object; an identification unit that identifies, out of the image formation units, a first image formation unit which performs the image formation using a first developer which is the developer with the lowest reflectance, by utilizing reflectance information indicating reflectances of the developers for the image formation units, or color information indicating the colors of the developers for the image formation units; and a corrector that corrects the color misregistration with respect to the first image formation unit identified by the identification unit.

A second aspect of the invention is an information processing device that includes: an identification unit that identifies, out of the image formation units mounted in series in a conveyance direction of a transfer object and forming developer images of respectively different colors and correction patterns of the different colors on the transfer object by using developers with the different colors, a first image formation unit which performs image formation using a first developer which is the developer with the lowest reflectance, by utilizing reflectance information indicating reflectances of the developers for the image formation units or color information indicating the colors of the developers for the image formation units; and a corrector that corrects a color misregistration, which is a variation in formation position of the developer image on the transfer object between the colors, with respect to the first image formation unit identified by the identification unit.

According to the aspects of the invention, it is possible to improve convenience.

BRIEF DESCRIPTION OF THE DRAWINGS

FIG. 3 is a schematic table illustrating an example of reflectance information on each toner;

FIG. 4 is a schematic table illustrating an example of reflectance information on an intermediate transfer belt;

FIG. 5 is a schematic table illustrating an example of a setting table for the amount of emission according to the first embodiment;

FIG. 6 is a schematic table illustrating an example of a lower limit of the dynamic range of the light amount of reflection light;

FIGS. 8A and 8B are each a schematic table illustrating examples of reflection levels and dynamic ranges;

FIG. 12 is a schematic table illustrating an example of color information on toner according to a second embodiment;

FIG. 13 is a schematic table illustrating an example of a setting table for the amount of emission according to the second embodiment;

DETAILED DESCRIPTION OF EMBODIMENTS

Figure 1:
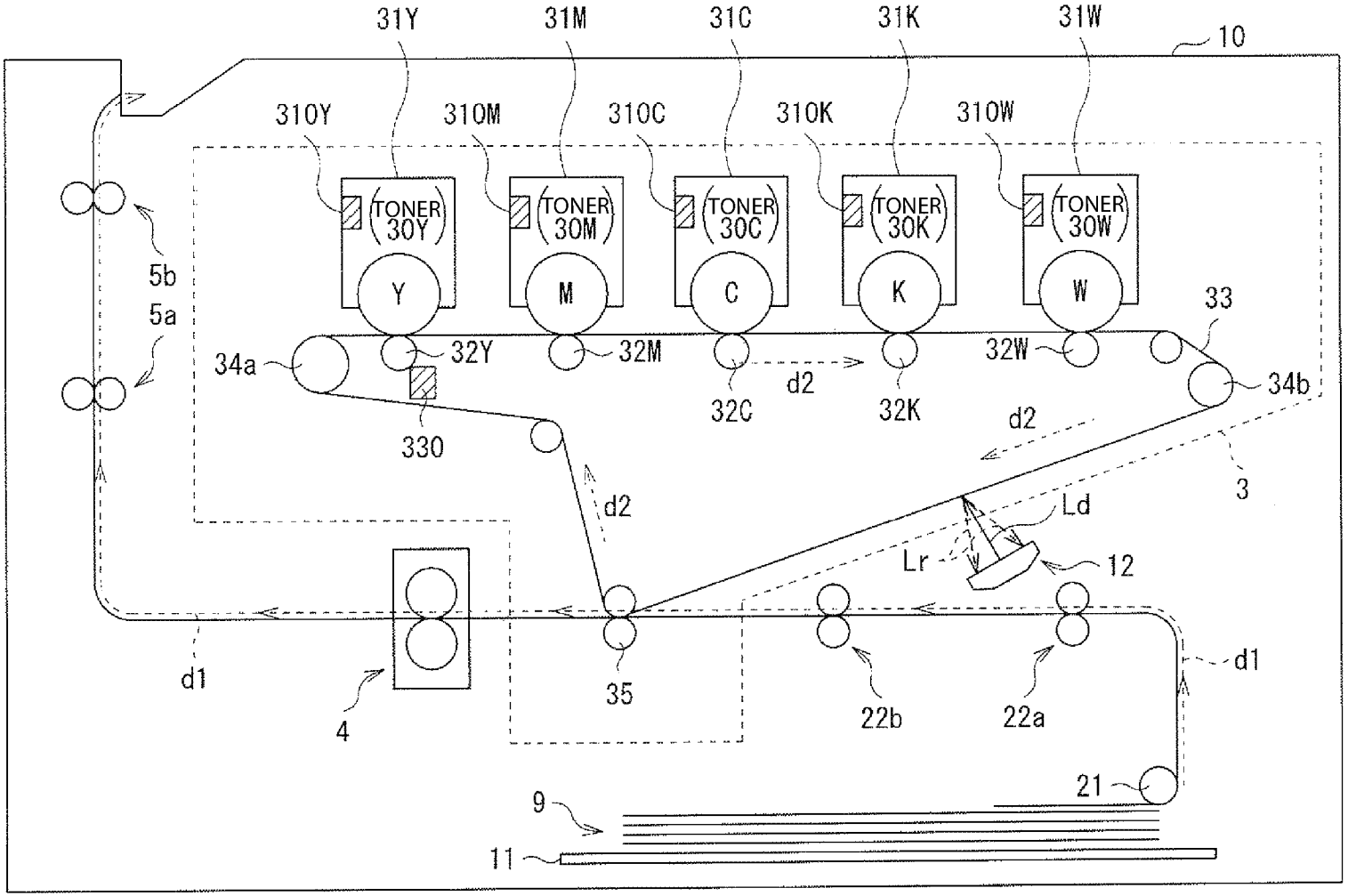
FIG. 1 is a schematic diagram illustrating an overall configuration example of an image formation apparatus according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

The description is given in the following order.

1. First embodiment (an example of a case where a color misregistration is corrected utilizing reflectance information).

2. Second embodiment (an example of a case where a color misregistration is corrected utilizing color information).
3. Modification (an example of application to an image formation apparatus that uses a direct transfer system).
4. Other modifications.

1. First Embodiment

Schematic Configuration

FIG. 1 schematically illustrates an overall configuration example of an image formation apparatus (image formation apparatus 1) according to a first embodiment of the invention. Image formation apparatus 1 functions as a printer (a color printer in this example) that forms an image (a color image in this example) on print medium 9 using electrophotography. As described below, image formation apparatus 1 is an image formation apparatus that uses a so-called intermediate transfer method in which a toner image is transferred to print medium 9 via a later-described intermediate transfer belt 33. It is to be noted that image formation apparatus 1 corresponds to a specific example of the "image formation apparatus" in the invention.

As illustrated in FIG. 1, the image formation apparatus includes paper sheet cassette 11, supply roller 21, conveyance rollers 22*a*, 22*b*, image formation section 3, sensor 12, fixture unit 4 (fixing device), and discharge rollers 5*a*, 5*b*. As illustrated in FIG. 1, each of these members is housed in predetermined case 10 having an openable and closable cover (not illustrated).

(Paper Sheet Cassette 11 and Other Members)

Paper sheet cassette 11 is a member that houses print medium 9 in stacked layers. In the example illustrated in FIG. 1, paper sheet cassette 11 serves as a built-in tray which is removably attached to a lower portion inside image formation apparatus 1.

Supply roller 21 is a member (a paper feed mechanism) that takes sheets one by one separately from the top of print medium 9 housed in paper sheet cassette 11 and feeds the sheets in the direction of conveyance rollers 22*a*, 22*b*.

Each of conveyance rollers 22*a*, 22*b* is a member that conveys print medium 9 in conveyance direction d1 utilizing the rotation of the rollers and conveys print medium 9 to a later-described secondary transfer roller 35.

(Image Formation Section 3)

Image formation section 3 is a unit that performs image formation (printing) on print medium 9 conveyed by conveyance rollers 22*a*, 22*b*. In this example, as illustrated in FIG. 1, image formation section 3 has five image drum units (image formation units) 31Y, 31M, 31C, 31K, 31W, and the secondary transfer roller 35. In addition, image formation section 3 has five primary transfer rollers 32Y, 32M, 32C, 32K, 32W, intermediate transfer belt 33, and two drive rollers 34*a*, 34*b* all functioning as an intermediate transfer belt unit. It is to be noted that image formation section 3 is additionally provided with actuators and the like, such as a motor and a clutch, for instance.

As illustrated in FIG. 1, image drum units 31Y, 31M, 31C, 31K, 31W are disposed in series in conveyance direction (conveyance path) d2 of the later-described intermediate transfer belt 33. Specifically, the image drum units 31Y, 31M, 31C, 31K, 31W are disposed in the order of image drum units 31Y, 31M, 31C, 31K, 31W in conveyance direction d2 (from the upstream side to the downstream side). It is to be noted that image drum units 31Y, 31M, 31C, 31K, 31W are individually mounted in the above-mentioned order at predetermined mounting positions (five mounting positions in this example) in case 10.

Herein, image drum units 31Y, 31M, 31C, 31K, 31W correspond to a specific example of the "image formation units" in the invention. In this embodiment, image drum unit 31K out of these image drum units corresponds to a specific example of the "first image formation unit" in the invention. The other image drum units 31Y, 31M, 31C, 31W correspond to a specific example of the "second image formation unit" in the invention. Furthermore, in the embodiment, the above-mentioned conveyance direction d2 corresponds to a specific example of the "conveyance direction" in the invention.

These image drum units 31Y, 31M, 31C, 31K, 31W form an image (toner image) on the later-described intermediate transfer belt 33 using toners (developers) of different colors. Specifically, as illustrated in FIG. 1, image drum unit 31Y forms a yellow toner image using a yellow (Y) toner (toner 30Y), and image drum unit 31M forms a magenta toner image using a magenta (M) toner (toner 30M). Similarly, image drum unit 31C forms a cyan toner image using a cyan (C) toner (toner 30C), and image drum unit 31K forms a black toner image using a black (K) toner (toner 30K). Image drum unit 31W forms a white toner image using a white (W) toner (toner 30W).

Here, these toners 30Y, 30M, 30C, 30K, 30W each correspond to a specific example of the "developer" in the invention, and toner 30K out of these toners corresponds to a specific example of the "black developer" in the invention. In the embodiment, toner 30K out of these toners corresponds to a specific example of the "first developer" in the invention, and other toners 30Y, 30M, 30C, 30W each correspond to a specific example of the "second developer" in the invention. Furthermore, each color toner image mentioned above corresponds to a specific example of the "developer image" in the invention.

In the embodiment, image drum units 31Y, 31M, 31C, 31K, 31W also form correction patterns (correction patterns Pd, Pm described later) of predetermined colors on intermediate transfer belt 33 using the respective color toners.

As the coloring agent used in these yellow, magenta, cyan, black, and white toners (toners 30Y, 30M, 30C, 30K, 30W), for instance, a dye or pigment may be used independently or in a combination of several types.

Here, image drum units 31Y, 31M, 31C, 31K, 31W have the same configuration except that a toner image (developer image) is formed using the toners of different colors as described above. Specifically, as a mechanism for forming such a toner image, these image drum units 31Y, 31M, 31C, 31K, 31W each have a toner cartridge (developer container), a photoconductive drum (image carrier), a charge roller (charge member), a development roller (developer carrier), a supply roller (developer supply member), and a cleaning member. In addition, an exposure head (exposure device) is individually disposed opposite to each of image drum units 31Y, 31M, 31C, 31K, 31W, and as illustrated in FIG. 1, tag chips 310Y, 310M, 310C, 310K, 310W are mounted on image drum units 31Y, 31M, 31C, 31K, 31W, respectively.

A toner cartridge is a container in which toner having one of the aforementioned colors is stored (housed). A photoconductive drum is a member that carries an electrostatic latent image on its surface (surface layer portion), and is formed with a photoreceptor (for instance, an organic photoreceptor). A charge roller is a member that charges the surface of a photoconductive drum, and is disposed so as to be in contact with the surface (circumferential surface) of the photoconductive drum. A development roller is a member that supports toner for developing an electrostatic latent image on the surface, and is disposed so as to be in contact with the surface of the photoconductive drum. A supply roller is a member for supplying toner to the development roller, and is disposed so as to be in contact with the surface of the development roller. A cleaning member is a member for scraping off and removing (cleaning) the toner remaining (remaining toner) on the surface of the photoconductive drum after a toner image is primarily transferred to a transfer object (the later-described intermediate transfer belt 33).

The aforementioned exposure head is a device that irradiates the surface of the above-described photoconductive drum with an emission light for exposure, thereby forming an electrostatic latent image on the surface (surface layer portion) of the photoconductive drum. Such an exposure head includes, for instance, light sources that emit emission light, and a lens array that focuses the emission light to form an image on the surface of the photoconductive drum. It is to be noted that these light sources include, for instance, a light emitting diode (LED) and a laser device.

The above-described intermediate transfer belt unit is a belt unit to which color toner images formed by image drum units 31Y, 31M, 31C, 31K, 31W are primarily transferred (intermediately transferred) as illustrated in FIG. 1. Also, as described later, the color toner images thus primarily transferred are secondarily transferred from the intermediate transfer belt unit to print medium 9 which is conveyed in conveyance direction d1.

As described above, the intermediate transfer belt unit has five primary transfer rollers 32Y, 32M, 32C, 32K, 32W, intermediate transfer belt 33, and two drive rollers 34*a*, 34*b*.

Primary transfer rollers 32Y, 32M, 32C, 32K, 32W are each a member for electrostatically transferring (primarily transferring) a corresponding one of the color toner images formed in image drum units 31Y, 31M, 31C, 31K, 31W onto intermediate transfer belt 33. As illustrated in FIG. 1, these primary transfer rollers 32Y, 32M, 32C, 32K, 32W are disposed opposite to image drum units 31Y, 31M, 31C, 31K, 31W, respectively, with intermediate transfer belt 33 interposed therebetween.

Intermediate transfer belt 33 is a belt, on the surface of which each color toner image formed by image drum units 31Y, 31M, 31C, 31K, 31W is primarily transferred as described above. In other words, such color toner image is temporarily carried on the surface of intermediate transfer belt 33. As illustrated in FIG. 1, intermediate transfer belt 33 is suspended by rollers including drive rollers 34*a*, 34*b*. Also, intermediate transfer belt 33 is driven by drive rollers 34*a*, 34*b* so as to rotate in conveyance direction d2 as illustrated in FIG. 1. Each color toner image thus primarily transferred onto the surface of intermediate transfer belt 33 is secondarily transferred onto print medium 9 as described later. Although details are described later, intermediate transfer belt 33 is also provided with tag chip 330.

Here, intermediate transfer belt 33 corresponds to a specific example of the "transfer object" and "conveyance member for the developer image and the correction pattern" in the invention.

Secondary transfer roller 35 illustrated in FIG. 1 is a member for electrostatically transferring (secondarily transferring) each color toner image onto print medium 9, the color toner image being primarily transferred onto intermediate transfer belt 33.

(Sensor 12)

Figure 2:
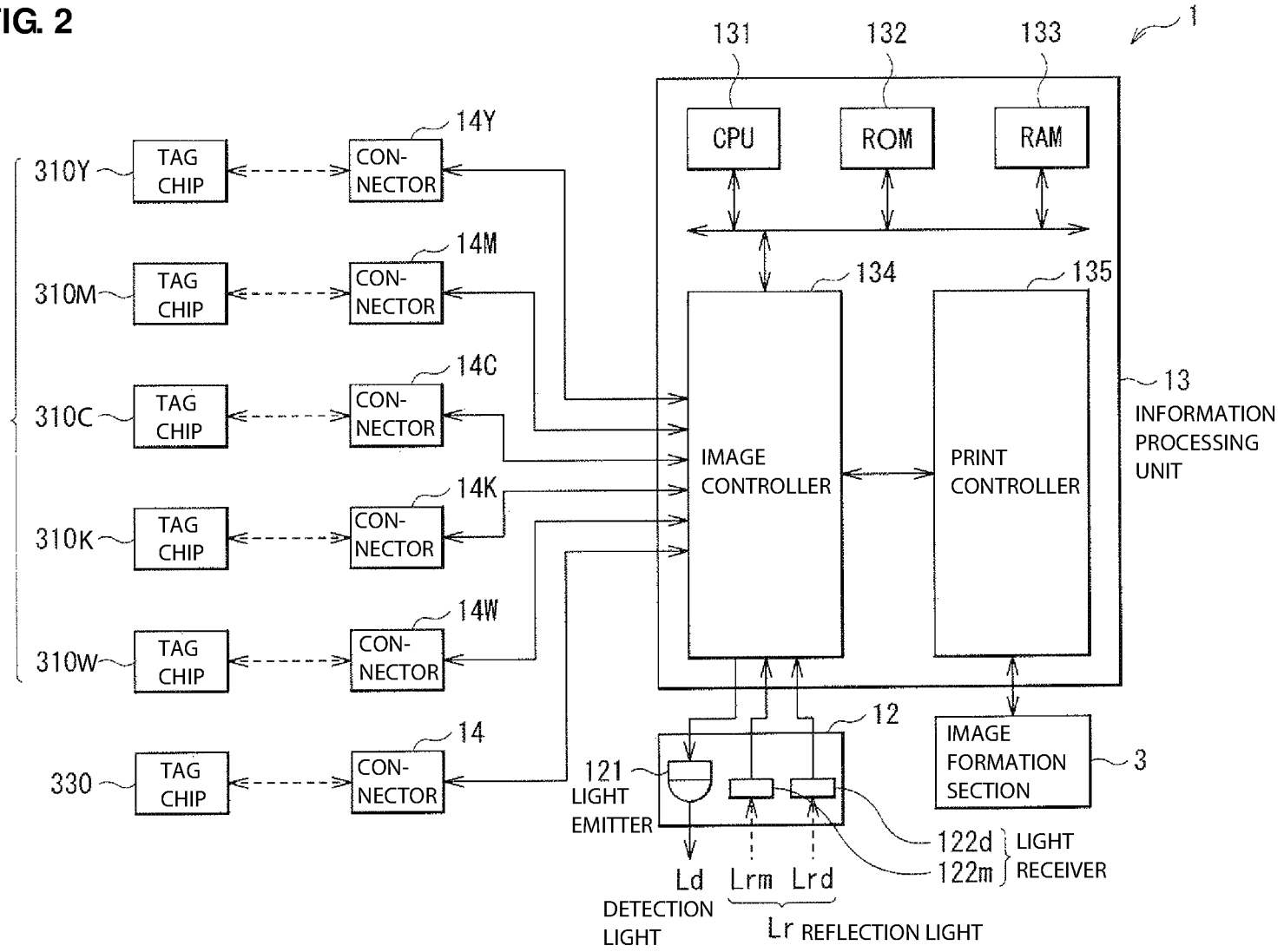
FIG. 2 is a block diagram illustrating a configuration example of a control mechanism of the image formation apparatus illustrated in FIG. 1.

As illustrated in FIG. 1, sensor 12 is a device that emits detection light Ld, such as infrared light, onto intermediate transfer belt 33, and receives reflection light (reflection light Lr) from intermediate transfer belt 33. Sensor 12 is designed to detect the later-described "color misregistration" by utilizing such emission of detection light Ld to the later-described correction pattern on intermediate transfer belt 33 and the reception of reflection light Lr from intermediate transfer belt 33. In other words, sensor 12 functions as a sensor for correcting a "color misregistration". Although the details are described later, the "color misregistration" refers to a phenomenon in which the formation positions of color toner images formed on intermediate transfer belt 33 vary among the colors (relative misalignment). It is to be noted that a detailed configuration example of such sensor 12 is described later (FIG. 2).

(Fixture Unit 4 and Others)

Fixture unit 4 is a device that fixes toner by applying heat and pressure to the toner (toner image) on print medium 9 which is conveyed in conveyance direction d1 after undergoing the above-mentioned secondary transfer.

Discharge rollers 5*a*, 5*b* are each a member for discharging print medium 9 conveyed in conveyance direction d1 to the outside of image formation apparatus 1.

[Configuration of the Control Mechanism]

Next, the control mechanism of image formation apparatus 1 is described with reference to FIGS. 2 to 6 in addition to FIG. 1. FIG. 2 is a block diagram illustrating a configuration example of the control mechanism of image formation apparatus 1 along with a controlled object.

As illustrated in FIG. 2, in this example, the following are provided as the control mechanism of image formation apparatus 1: tag chips 310Y, 310M, 310C, 310K, 310W, 330 as mentioned above, connectors 14Y, 14M, 14C, 14K, 14W, and information processing unit 13. In this example, sensor 12 as described above and image formation section 3 are illustrated as controlled objects.

(Detailed Configuration of Sensor 12)

First, a detailed configuration example of the above-described sensor 12 is described. As illustrated in FIG. 2, sensor 12 includes light emitter 121 and light receivers 122*d*, 122*m*. Light emitter 121 includes a light emitting device that emits a detection light Ld, such as infrared light, and the light emitting device includes, for instance, a light emitting diode (LED). Light receiving units 122*d*, 122*m* each include, for instance, a light receiving device having a sensitivity in an infrared region, and the light receiving device includes, for instance, a photo transistor.

Here, specifically, as illustrated in FIG. 2, light receiver 122*d* is a unit that receives a diffuse reflection light Lrd as above-mentioned, and reflection light Lr, and is supposed to be disposed at a position where the incident angle and the reflection angle of light are different. On the other hand, light receiver 122*m* is a unit that receives a specular reflection light Lrm as reflection light Lr, and is supposed to be disposed at a position where the incident angle and the reflection angle of light are substantially equal to each other. In this manner, sensor 12, on the whole, receives diffuse reflection light Lrd and specular reflection light Lrm both as reflection light Lr.

(Tag Chips 310Y, 310M, 310C, 310K, 310W)

As described above, tag chips 310Y, 310M, 310C, 310K, 310W are mounted on image drum units 31Y, 31M, 31C, 31K, 31W, respectively, and pre-store a variety of information. In this embodiment, the variety of information includes, for instance, the below-described reflectance information on each toner in addition to type information and count information on the printing.

FIG. 3 schematically illustrates an example of reflectance information (reflectance information 61) on each toner.

Reflectance information 61 provides information that indicates the reflectance of the toner for each of image drum units 31Y, 31M, 31C, 31K, 31W. Specifically, reflectance information 61 stored in tag chip 310Y in image drum unit 31Y provides information that indicates the reflectance of yellow toner (toner 30Y) described above. Similarly, reflectance information 61 stored in tag chip 310M in image drum unit 31M provides information that indicates the reflectance of magenta toner (toner 30M) described above. Reflectance information 61 stored in tag chip 310C in image drum unit 31C provides information that indicates the reflectance of cyan toner (toner 30C) described above. Reflectance information 61 stored in tag chip 310K in image drum unit 31K provides information that indicates the reflectance of black toner (toner 30K) described above. Reflectance information 61 stored in tag chip 310W in image drum unit 31W provides information that indicates the reflectance of white toner (toner 30W) described above. It is to be noted that such reflectance information 61 corresponds to a specific example of the "reflectance information" in the invention.

As illustrated in FIG. 3, in this example, such reflectance information 61 is expressed in terms of 4-bit data (name: and is classified to multiple scales (7 scales in this example) of reflection level according to the range of magnitude of the amount of reflection light. In this example, the amount of reflection light increases as the value of reflection level increases from "1" to "7". The light amount of the specular reflection, which is one of the above-described diffuse reflection and specular reflection, is used as the amount of reflection light (reflection level). This is because the amount of reflection light of each toner is approximately equal between the diffuse reflection and the specular reflection, and thus the light amount of specular reflection is used as a representative amount. It is to be noted that such amount of reflection light is specified based on, for instance, the result of a predetermined experiment or a result of measurement using a measuring instrument such as a photometer.

(Tag Chip 330)

On the other hand, as described above, tag chip 330 is mounted on intermediate transfer belt 33, and pre-stores a variety of information. In the embodiment, the variety of information includes, for instance, the below-described reflectance information on intermediate transfer belt 33 in addition to type information.

FIG. 4 schematically illustrates an example of such reflectance information (reflectance information 62) on intermediate transfer belt 33. As mentioned above, reflectance information 62 provides information that indicates the reflectance of intermediate transfer belt 33, and corresponds to a specific example of the "information indicating the reflectance of a transfer object" in the invention.

As illustrated in FIG. 4, in this example, such reflectance information 62 is expressed in terms of 8-bit data.

Specifically, reflectance information 62 includes 4-bit (4 bits from the 7th bit to the 4th bit) data (name: "D#R") indicating the light amount (diffuse reflection level) of diffuse reflection, and 4-bit (4 bits from the 3rd bit to the 0th bit) data (name: "M#R") indicating the light amount (specular reflection level) of specular reflection. These diffuse reflection and specular reflection levels are also classified to multiple scales (7 scales in this example) according to the range of magnitude of the amount of reflection light. In this example, the amount of reflection light increases as the value of diffuse reflection level and specular reflection level each increases from "1" to "7". It is to be noted that such an amount of reflection light is also specified based on, for instance, the result of a predetermined experiment or the result of a measurement using a measuring instrument such as a photometer.

In this regard, before image drum units 31Y, 31M, 31C, 31K, 31W and intermediate transfer belt 33 are mounted on image formation apparatus 1, such reflectance information 61, 62 along with identification information on these units are written to tag chips 310Y, 310M, 310C, 310K, 310W, 330 in advance. In order to distinguish between a tag chip to which no reflection level is written and a tag chip to which a reflection level is written, the initial value of each reflection level is "0x0", and in the case of "0x0", no proper reflection level has been written.

(Connectors 14Y, 14M, 14C, 14K, 14W)

Connectors 14Y, 14M, 14C, 14K, 14W, 14W illustrated in FIG. 2 are connected between the above-described tag chips 310Y, 310M, 310C, 310K, 310W, 330 and image controller 134 in a later-described information processing unit 13 by respective signal lines. Thus, the reading and writing of data in the variety of information (such as reflectance information 61, 62) stored in tag chip 310Y, 310M, 310C, 310K, 310W, 330 can be individually performed by image controller 134.

(Information Processing Unit 13)

As illustrated in FIG. 2, information processing unit 13 has central processing unit (CPU) 131, read only memory (ROM) 132, random access memory (RAM) 133, image controller 134, and print controller 135. Here, information processing unit 13 corresponds to a specific example of the "information processing device" in the invention. Also, image controller 134 corresponds to a specific example of the "identification unit", "setting unit" and "derivation unit", and print controller 135 corresponds to a specific example of the "corrector" in the invention.

CPU 131 is a calculation processing unit that controls the entire image formation apparatus 1, and performs various processing based on a control program for the entire image formation apparatus 1, stored in ROM 132.

ROM 132 is a memory that stores various parameters and a table (parameters and setting table 64 which are used when the later-described color misregistration is corrected) in addition to the above-mentioned control program.

RAM 133 is a work memory for storing various calculation results.

Image controller 134 has a function of converting print data (print job) to printable bit map data in image formation apparatus 1 according to a command from CPU 131. The print data is received via a communication line or the like from a higher level host (an external device such as a personal computer (PC)) which is not illustrated. In addition, image controller 134 has functions of generating a correction pattern of each color and supplying the correction pattern to print controller 135 in synchronization with a print timing signal (a later-described synchronization signal) when the later-described color misregistration correction is made.

Furthermore, image controller 134 has the function of digital to analog conversion (D/A conversion) at a terminal connected to light emitter 121 in sensor 12. Specifically, image controller 134 is able to adjust an output voltage based on a later-described setting table 64 and to adjust the current (emission current) flowing to light emitter 121 via a voltage/current conversion circuit which is not illustrated. In addition, image controller 134 has the function of analog to digital conversion (A/D conversion) at a terminal connected to light receivers 122*d*, 122*m* in sensor 12. Specifically, image controller 134 is able to convert an analog voltage value (a voltage value corresponding to the light amount of reflection light Lrd, Lrm) outputted from the light receivers 122*d*, 122*m* to a digital voltage value and to obtain the digital voltage value.

In the embodiment, image controller 134 also has the following functions. Specifically, image controller 134 has a function of identifying an image drum unit (reference position) out of image drum units 31Y, 31M, 31C, 31K, 31W that performs image formation using the toner with the lowest reflectance, by utilizing the above-described reflectance information 61. In addition, image controller 134 has a function of setting the amount of emission (emission current) of detection light Ld in sensor 12 for each toner in the image drum units other than the thus-identified image drum unit, by utilizing the above-described reflectance information 61, 62. For such setting of the amount of emission of detection light Ld, specifically, the below-described setting table 64 is used.

FIG. 5 schematically illustrates an example of such setting table 64. In setting table 64, for each of the diffuse reflections (diffuse reflection light Lrd) and specular reflection (specular reflection Lrm) described above, the amount of emission (emission current) of detection light Ld is classified to multiple scales (5 scales in this example) and is specified according to the range of magnitude of the later-described maximum reflection level. The maximum reflection level indicates the reflection level in a state where the light amount (reflection level) of reflection light Lr (diffuse reflection light Lrd or specular reflection light Lrm) has a maximum. In the following, the emission current regarding the diffuse reflection is denoted by emission current Id, and the emission current regarding the specular reflection is denoted by emission current Im. In this example, as illustrated in FIG. 5, the value of each of emission currents Id, Im is set to be lower as the maximum reflection level increases. Image controller 134 of the embodiment utilizes the maximum reflection level, thereby setting emission currents Id, Im of detection light Ld by selecting one of emission currents Id, Im pre-specified in setting table 64.

It is to be noted that such setting table 64 corresponds to a specific example of the "table" in the invention, and emission currents Id, Im of detection light Ld each correspond to a specific example of the "amount of emission of detection light" in the invention.

FIG. 6 illustrates an example of the lower limit (threshold value) Th of the dynamic range of the light amount (reflection level) of reflection light Lr. The dynamic range (which corresponds to later-described dynamic ranges ΔV(d), ΔV(m)) corresponds to the difference value between the maximum light amount and the minimum light amount (reflection levels) of reflection light Lr (diffuse reflection light Lrd or specular reflection light Lrm). In this example, as illustrated in FIG. 6, the lower limit (dynamic range lower limit Th) of such a dynamic range is specified for each of the diffuse reflection (diffuse reflection light Lrd) and the specular reflection (specular reflection Lrm). It is to be noted that dynamic range lower limit Th corresponds to a specific example of the "threshold value" in the invention.

In the embodiment, image controller 134 has a function of determining (deriving) the above-mentioned dynamic range of the light amount of reflection light Lr by utilizing reflectance information 61, 62 described above. The details of various functions (various operations) in image controller 134 explained so far are described later.

Print controller 135 illustrated in FIG. 2 controls the operation (performs printing control) of each member in image formation section 3 based on the print data (bit map data) and correction pattern of each color generated in image controller 134. Particularly, in the embodiment, print controller 135 has a function of performing color misregistration correction using the amount of emission (emission current) of detection light Ld set in image controller 134. Specifically, print controller 135 performs such color misregistration correction by controlling the operation (such as print timing) of each member in image formation section 3. In this process, for instance, when the dynamic range determined by image controller 134 as described above is greater than or equal to dynamic range lower limit Th illustrated in FIG. 6, print controller 135 performs color misregistration correction. Conversely stated, when the determined dynamic range is less than dynamic range lower limit Th, color misregistration correction is not performed because the correction of a color misregistration may not be properly performed. The details of various functions (various operations) in such print controller 135 are described later.

Operation and Effect

A. Basic Operation of Entire Image Formation Apparatus 1

Image formation apparatus 1 forms an image (performs a printing operation) on print medium 9 in the following manner. In other words, when print data is supplied to image controller 134 via a communication line or the like from an external device such as a PC, image controller 134 and print controller 135 execute a print processing based on the print data so that the members in image formation apparatus 1 perform the following operations.

As illustrated in FIG. 1, print medium 9 stored in paper sheet cassette 11 is first conveyed in conveyance direction d1 (along a conveyance path) by supply roller 21 and conveyance rollers 22*a*, 22*b*. Then, each color toner image is formed on the thus-conveyed print medium 9 by image formation section 3.

Specifically, first, in each of image drum units 31Y, 31M, 31C, 31K, 31W in image formation section 3, each color toner image is formed by an electrophotographic process based on the above-mentioned print data. Each color toner image thus formed is then primarily transferred onto intermediate transfer belt 33 successively in conveyance direction d2. The toner image (the primarily transferred toner image) on intermediate transfer belt 33 is secondarily transferred to print medium 9 conveyed by secondary transfer roller 35.

Subsequently, fixture unit 4 applies heat and pressure to the toner on print medium 9 conveyed from secondary transfer roller 35, and the toner is thereby fixed onto print medium 9. Print medium 9, on which the fixing operation has been performed in this manner, is discharged to the outside of image formation apparatus 1 through discharge rollers 5*a*, 5*b*. At this point, the image formation operation in image formation apparatus 1 is completed.

B. Color Misregistration Correction Operation

Incidentally, when such an image formation operation is performed, the formation positions of the color toner images formed on intermediate transfer belt 33 may vary among the colors (relative misalignment), that is, the "color misregistration" as described so far may occur. Various techniques have been used in the conventional art to reduce such a color misregistration in an image formation device.

B-1. Comparative Example

Similarly to the color misregistration correction in the embodiment, a technique according to a comparative example in the conventional art also performs color misregistration correction by utilizing light emission and light reception by a sensor, information on the reflectance of each color toner, and a correction pattern of each color. However, in the technique of the comparative example, when the mounting positions of image drum units are interchanged, or an image drum unit, which uses special toner, is mounted, the following problem may occur.

That is, with the technique of the comparative example, movement of the positions of the image drum units (toner) is not taken into consideration and it is a precondition that the positions are fixed (the output order and detection order of the correction patterns of the colors are predetermined). Therefore, for instance, when image drum unit 31K is mounted on the mounting position of image drum unit 31Y, the following is performed. That is, in this case, although it is expected that a correction pattern is formed based on the yellow toner (toner 30Y), actually, a correction pattern is formed based on the black toner (toner 30K). Thus it is difficult to perform color misregistration correction properly (accurately). It may be possible to take measures, for instance, by changing the correction technique, but in this case, the change results in a complicated correction technique and/or an increase in cost.

For these reasons, with the technique of the comparative example, for instance when the mounting positions of image drum units are interchanged, or an image drum unit, which uses special toner, is mounted, an inconvenience may be imposed when a color misregistration is corrected.

B-2. This Embodiment

In image formation apparatus 1 of the embodiment, the above-described problem in the comparative example is solved by performing a correction operation for a color misregistration using the technique described below.

(Setting of the Amount of Emission in Sensor 12)

First, information processing unit 13 in image formation apparatus 1 sets the amount of emission (emission current) of detection light Ld used in a correction operation for a color misregistration in sensor 12 in the following manner. Specifically, image controller 134 identifies an image drum unit (reference position) out of image drum units 31Y, 31M, 31C, 31K, 31W that performs image formation using a toner with the lowest reflectance, by utilizing the above-described reflectance information 61. In addition, image controller 134 sets the amount of emission of detection light Ld in sensor 12 for each toner in the image drum units other than the thus-identified image drum unit by utilizing the above-described reflectance information 61, 62.

Figure 7:
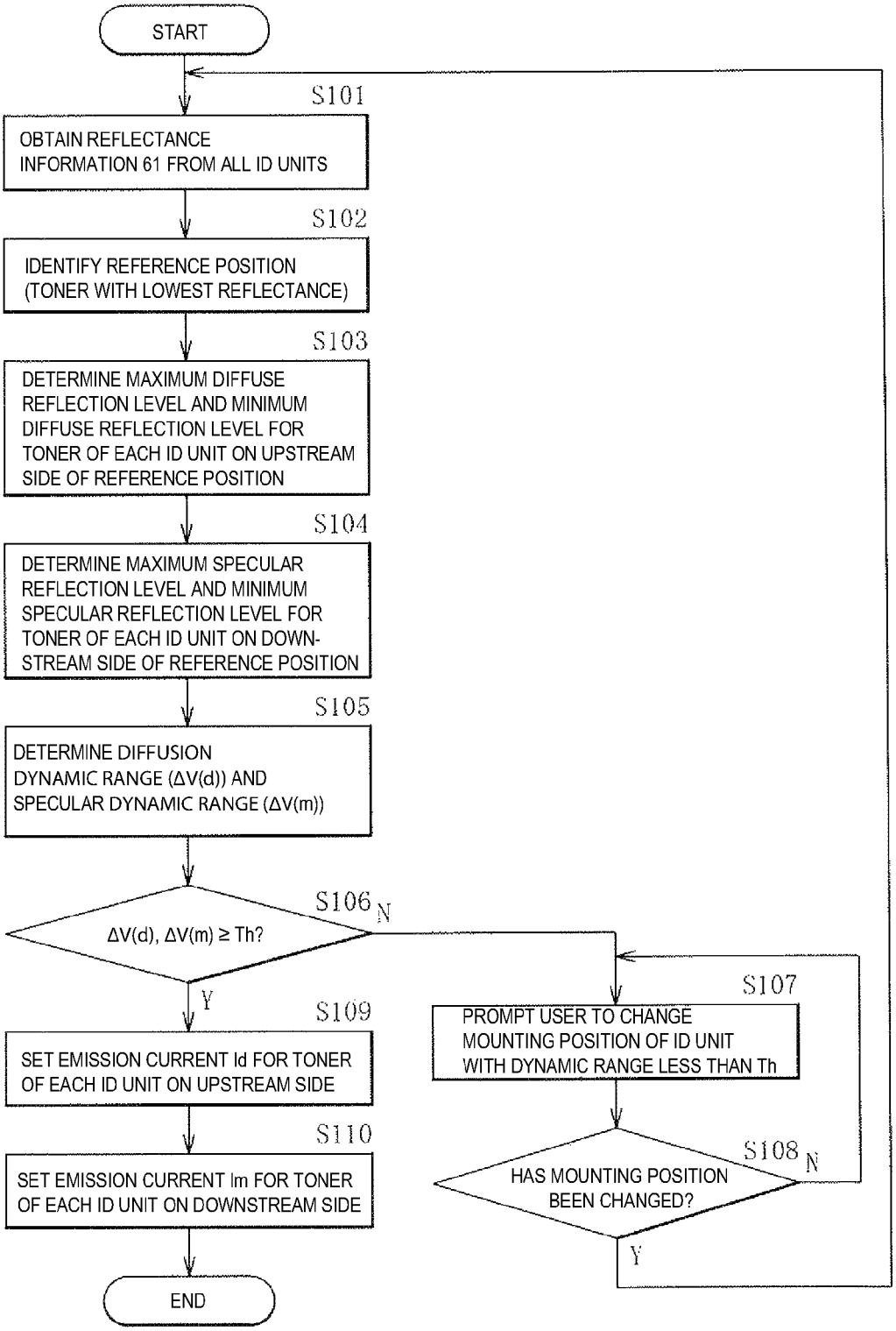
FIG. 7 is a flow chart illustrating an example of a method of setting the amount of emission according to the first embodiment.

FIG. 7 is a flow chart illustrating an example of a method of setting the amount of emission of detection light Ld according to the embodiment. FIGS. 8A and 8B schematically illustrate examples of the above-described reflection levels and dynamic ranges used in such setting of the amount of emission. It is to be noted that before a correction of a color misregistration, such a setting of the amount of emission is automatically performed, which is triggered by, for instance, the start of image formation apparatus 1 or an operation such as opening or closing of a cover in case 10.

In this method of setting the amount of emission, image controller 134 first obtains reflectance information 61 (the reflection level in the toner of each color) stored in the respective tag chips 310Y, 310M, 310C, 310K, 310W from all image drum units (ID units) 31Y, 31M, 31C, 31K, 31W (step S101 of FIG. 7). Subsequently, image controller 134 identifies the mounting position of an image drum unit as a reference position, which uses the toner with the lowest reflection level (reflectance) out of the thus-obtained reflection levels of the respective toners of each of the colors (step S102). For instance, in the example of FIGS. 8A and 8B, the mounting position of image drum unit 31K, which uses the black toner (toner 30K) with the lowest reflection level, is identified as a reference position (see FIG. 8A).

Subsequently, image controller 134 uses the following Expression (1) and Expression (2) for the toner of each image drum unit on the upstream side of the thus-identified reference position to determine (calculate) a maximum diffuse reflection level and a minimum diffuse reflection level (step S103). For instance, in the example of FIGS. 8A and 8B, a maximum diffuse reflection level and a minimum diffuse reflection level are determined for toners 30Y, 30M, 30C of image drum units 31Y, 31M, 31C located on the upstream side of the mounting position of image drum unit 31K (see FIG. 8B).

Hereinafter, the reflection level of the toner at the reference position is referred to as the "reference toner reflection level", the reflection level of each toner located on the upstream side of the reference position is referred to as the "upstream toner reflection level", and the reflection level of each toner located on the downstream side of the reference position is referred to as the "downstream toner reflection level" (see FIG. 3 and FIG. 8A). Also, the diffuse reflection level in intermediate transfer belt 33 is referred to as the "belt diffuse reflection level", and the specular reflection level in intermediate transfer belt 33 is referred to as the "belt specular reflection level" (see FIG. 4 and FIG. 8A).

$$\text{maximum diffuse reflection level}=(\text{upstream toner reflection level}+\text{reference toner reflection level})/2 \quad (1)$$

$$\text{minimum diffuse reflection level}=(\text{reference toner reflection level}+\text{belt diffuse reflection level})/2 \quad (2)$$

Subsequently, image controller 134 uses the following Expression (3) and Expression (4) for the toner of each image drum unit on the downstream side of the reference position to determine (calculate) a maximum specular reflection level and a minimum specular reflection level (step S104). For instance, in the example of FIGS. 8A and 8B, a maximum specular reflection level and a minimum specular reflection level are determined for toner 30W of image drum unit 31W located on the downstream side of the mounting position of image drum unit 31K (see FIG. 8B).

$$\text{maximum specular reflection level}=(\text{downstream toner reflection level}+\text{belt specular reflection level})/2 \quad (3)$$

$$\text{minimum specular reflection level}=(\text{reference toner reflection level}+\text{downstream toner reflection level})/2 \quad (4)$$

Subsequently, image controller 134 uses the following Expression (5) and Expression (6) to determine the above-described dynamic range ΔV(d) (diffusion dynamic range) and dynamic range ΔV(m) (specular dynamic range) (see step S105, FIG. 8B).

$$\Delta V(d)=(\text{maximum diffuse reflection level}-\text{minimum diffuse reflection level}) \quad (5)$$

$$\Delta V(m)=(\text{maximum specular reflection level}-\text{minimum specular reflection level}) \quad (6)$$

Subsequently, image controller 134 determines whether or not the thus determined dynamic ranges ΔV(d), ΔV(m) are both greater than or equal to the above-described dynamic range lower limit Th (whether or not ΔV(d)≥Th and ΔV(m)≥Th are satisfied) (step S106). Here, when it is determined that at least one of dynamic ranges ΔV(d) and ΔV(m) is less than dynamic range lower limit Th (N in step S106), the following is performed. That is, information processing unit 13 uses, for instance, the display screen of image formation apparatus 1 to prompt a user to change the mounting position of a relevant image drum unit (having a dynamic range less than dynamic range lower limit Th) (step S107). Information processing unit 13 then utilizes, for instance, a predetermined sensor to determine whether or not such change of the mounting position has been made by the user (step S108). When it is determined that the mounting position has not been changed yet (N in step S108), the flow returns to step S107 again. On the other hand, when it is determined that the mounting position has been changed (Y in step S108), the flow returns to step S101 described above. In this manner, only when dynamic ranges ΔV(d), ΔV(m) are greater than or equal to dynamic range lower limit Th, is the subsequent processing (such as later-described color misregistration correction) performed.

On the other hand, when it is determined that dynamic ranges ΔV(d), ΔV(m) are both greater than or equal to dynamic range lower limit Th (Y in step S106), the following is performed. That is, image controller 134 first uses, for instance, setting table 64 illustrated in FIG. 5 for the toner of each image drum unit on the upstream side of the identified reference position, thereby setting emission current Id of detection light Ld in sensor 12 (step S109). For instance, in the example of FIGS. 8A and 8B, for toners 30Y, 30M, 30C of image drum units 31Y, 31M, 31C located on the upstream side of the mounting position of image drum unit 31K, the following is performed. That is, for each of toners 30Y, 30M, 30C, the value of the maximum diffuse reflection level determined in step S103 is "2.5" (see FIG. 8B), and thus emission current Id=22.5 (mA) (see FIG. 5).

Subsequently, image controller 134 uses, for instance, setting table 64 illustrated in FIG. 5 for the toner of each image drum unit on the downstream side of the reference position, thereby setting emission current Im of detection light Ld in sensor 12 (step S110). For instance, in the example of FIGS. 8A and 8B, for toner 30W of image drum unit 31W located on the downstream side of the mounting position of image drum unit 31K, the following is performed. That is, for toners 30W, the value of the maximum specular reflection level determined in step S104 is "6" (see FIG. 8B), and thus emission current Id=7.0 (mA) (see FIG. 5). At this point, the series of processing in the method of setting the amount of emission of detection light Ld illustrated in FIG. 7 is completed.

(Detection of Color Misregistration)

Subsequently, information processing unit 13 and sensor 12 use the thus-set amount of emission of detection light Ld to detect a color misregistration in the following manner.

Figure 9:
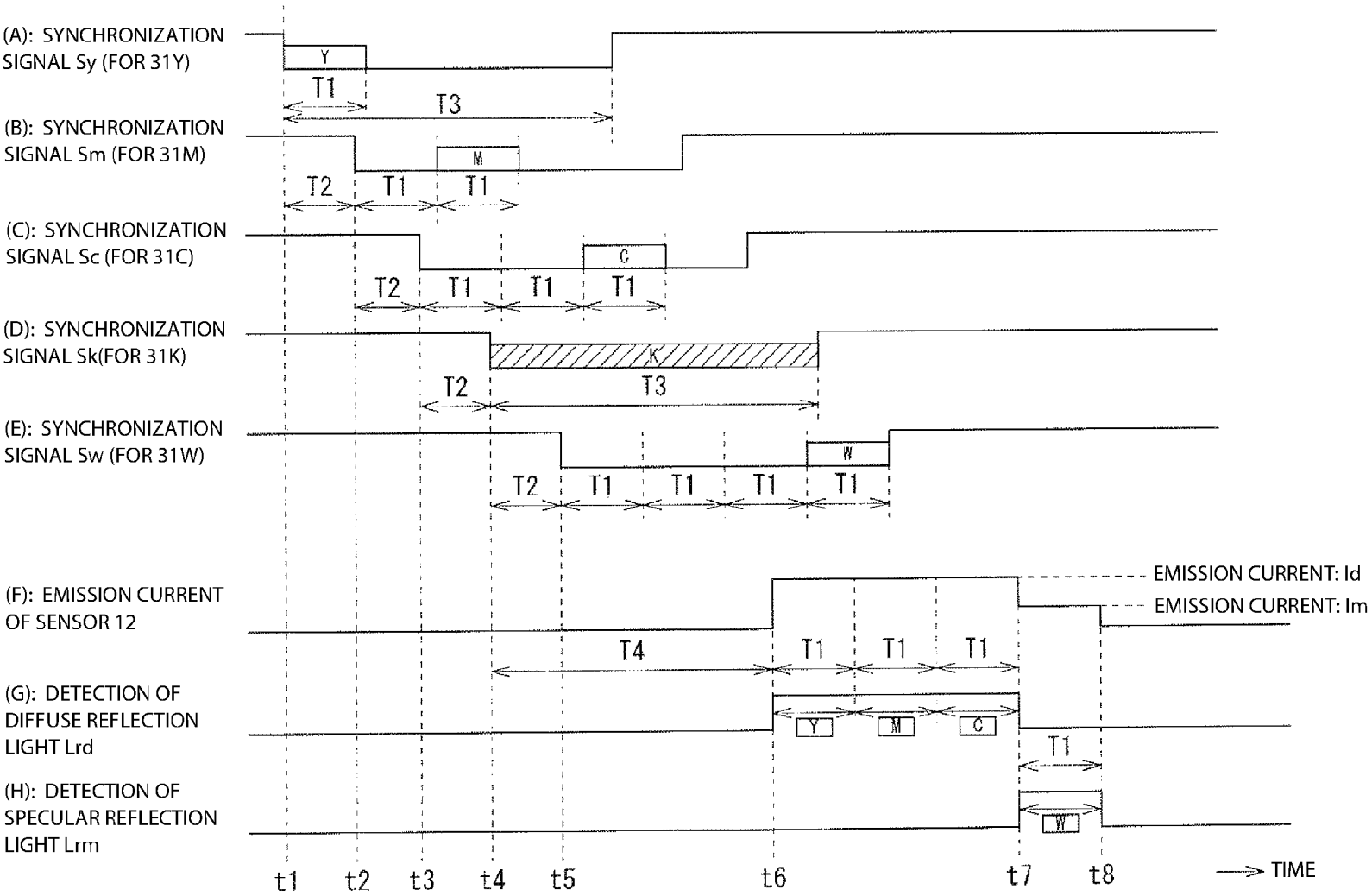
FIG. 9 is a timing chart illustrating an example of a color misregistration detection operation utilizing correction patterns.

FIG. 9 is a timing chart schematically illustrating an example of a color misregistration detection operation utilizing the above-described correction patterns (correction patterns Pd, Pm). FIG. 9 illustrates timing waveforms (A) to (E) of the synchronization signals Sy, Sm, Sc, Sk, Sw which are used for image formation in image drum units 31Y, 31M, 31C, 31K, 31W. These synchronization signals Sy, Sm, Sc, Sk, Sw along with the above-described bit map data are supplied from image controller 134 to print controller 135. When a synchronization signal is in the "L (low)" state, a corresponding bit map data (correction pattern) becomes effective. Waveform (F) in FIG. 9 illustrates a state of a temporal change of the emission current of detection light Ld in sensor 12. Waveforms (G) and (H) in FIG. 9 schematically illustrate detected states of diffuse reflection light Lrd and specular reflection light Lrm.

FIGS. 10A to 10D provide a timing diagram schematically illustrating an example of a color misregistration detection operation by detecting the above-described diffuse reflection light Lrd. FIGS. 11A to 11D provide a timing diagram schematically illustrating an example of a color misregistration detection operation by detecting the above-described specular reflection light Lrm. It is to be noted that in FIGS. 10A to 10D, for the sake of convenience, diffuse reflection light Lrd from toners 30K, 30A (mentioned later) are denoted by diffuse reflection light Lrd-K, Lrd-A, respectively. Also, In FIGS. 11A to 11D, for the sake of convenience, specular reflection light Lrm from toners 30K, 30W and intermediate transfer belt 33 are denoted by specular reflection light Lrm-K, Lrm-W, Lrm-B, respectively.

When the detection of a color misregistration is made, for instance, as illustrated in FIG. 9, synchronization signal Sy first becomes an "L" state at timing t1, and data of the correction pattern formed of toner 30Y of image drum unit 31Y is outputted only during the time period T1. It is to be noted that time period T1 corresponds to a time taken for forming the correction pattern of each color, and is determined according to the correction details and correction accuracy for a color misregistration.

Subsequently, at timing t2 when a time period 12 has elapsed since timing t1, synchronization signal Sm becomes an "L" state, and after an elapse of time period T1 since timing t2, data of the correction pattern formed of toner 30M of image drum unit 31M is outputted only during time period T1. Similarly, at timing t3 when a time period 12 has elapsed since timing t2, synchronization signal Sc becomes an "L" state, and after an elapse of twice the time period T1 since timing t3, data of the correction pattern formed of toner 30C of image drum unit 31C is outputted only during time period T1. On the other hand, at timing t4 when a time period 12 has elapsed since timing t3, synchronization signal Sk becomes an "L" state, and during time period T3 from timing t4 (for the entire time period in which synchronization signal Sk is in the "L" state), data of the correction pattern formed of toner 30K of image drum unit 31K is outputted. This is because image drum unit 31K corresponds to the reference position. At timing t5 when time period T2 has elapsed since timing t4, synchronization signal Sw becomes an "L" state, and after an elapse of three times the time period T1 since timing t5, data of the correction pattern formed of toner 30W of image drum unit 31W is outputted only during time period T1. It is to be noted that the above-mentioned time period T2 is determined by the interval between adjacent image drum units and the conveyance speed of intermediate transfer belt 33.

Subsequently, at timing t6 when a time period T4 has elapsed since timing t4, sensor 12 starts an operation of detecting the correction pattern of each color. Specifically, during the time period from timing t6 to t7, an operation of detecting the correction patterns formed of toners 30Y, 30M, 30C is performed by utilizing the emission of detection light Ld using emission current Id (for instance, 22.5 mA mentioned above) set by the above-described method and the reception of diffuse reflection light Lrd. That is, a detection operation utilizing the reception of diffuse reflection light Lrd is performed for the correction patterns formed by toners 30Y, 30M, 30C of image drum units 31Y, 31M, 31C located on the upstream side of the mounting position (reference position) of image drum unit 31K. As illustrated in waveforms (A) to (H) in FIG. 9, in this example, the time period of the detection operation for the correction patterns formed of toners 30Y, 30M, 30C is time period T1.

Subsequently, during the following time period from timing t7 to t8, an operation of detecting the correction pattern formed of toner 30W is performed by utilizing the emission of detection light Ld using emission current Im (for instance, 7.0 mA mentioned above) set by the above-described method and the reception of specular reflection light Lrm. That is, a detection operation utilizing the reception of specular reflection light Lrm is performed for the correction pattern formed by toner 30W of image drum unit 31W located on the downstream side of the mounting position (reference position) of image drum unit 31K. As illustrated in waveforms (A) to (H) in FIG. 9, in this example, the time period of the detection operation for the correction pattern formed of toner 30W is time period T1.

Figures 10A, 10B, 10C, 10D:
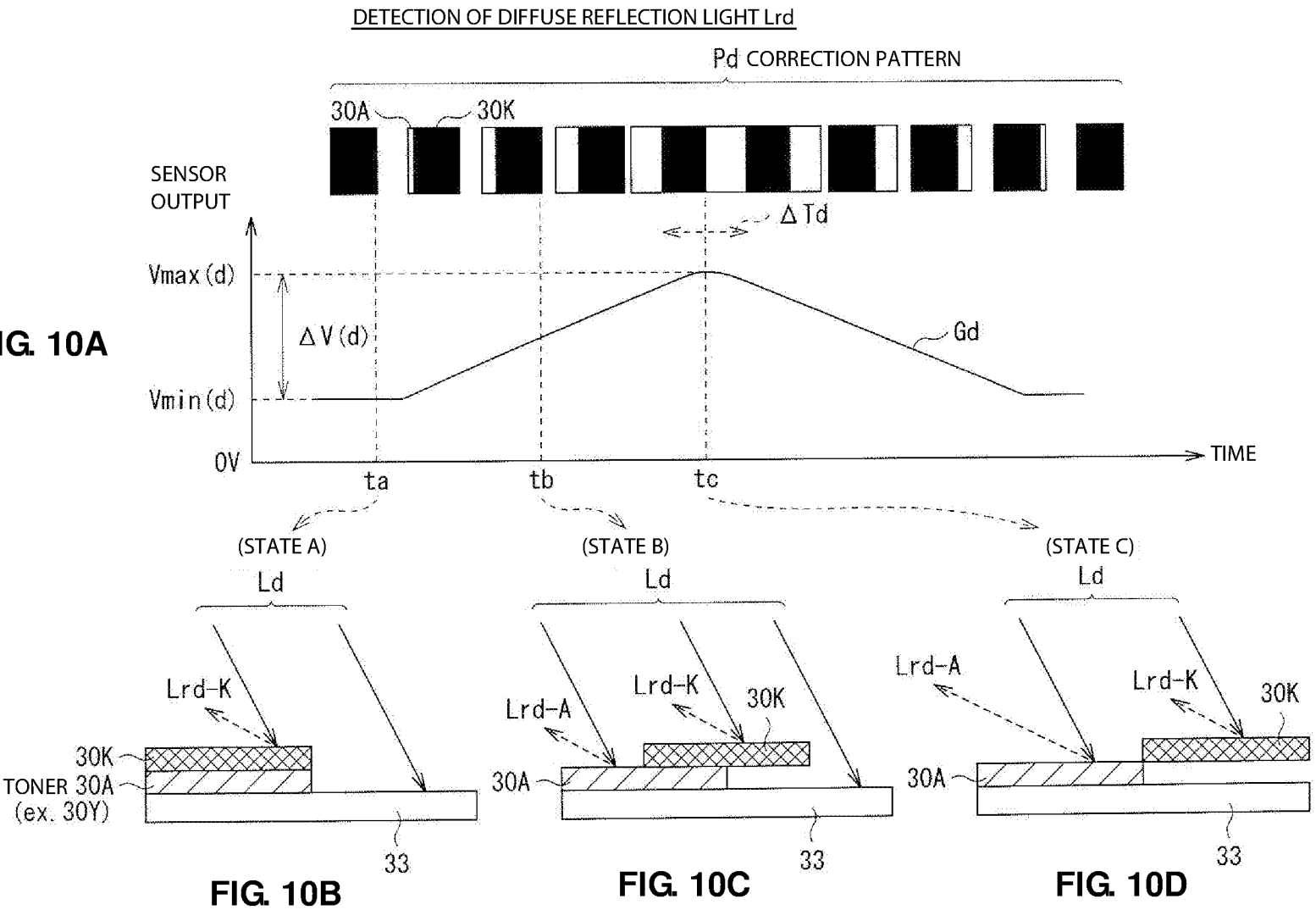
FIGS. 10A to 10D provide a timing diagram illustrating an example of a color misregistration detection operation by detecting diffuse reflection light.

For instance, as illustrated in FIGS. 10A to 10D, when the above-mentioned detection operation (timing t6 to t7) utilizing the reception of diffuse reflection light Lrd is performed, a color misregistration is detected utilizing the detection of the correction pattern (correction pattern Pd) of each color in the following manner. In this example, as illustrated in FIG. 10A, correction patterns of two colors are formed one on top of another with their relative positions shifted little by little in conveyance direction d2 on intermediate transfer belt 33. Specifically, when the detection operation utilizing the reception of diffuse reflection light Lrd is performed, correction pattern Pd, which is formed using toner 30K corresponding to the reference position, is disposed on the upper side (upper layer side) of correction pattern Pd which is formed using toner 30A (one of toners 30Y, 30M, 30C).

In this case, first, in the state (state A, see FIG. 10B) at timing ta (see FIG. 10A), correction pattern Pd formed of toner 30A is completely covered by correction pattern Pd formed of toner 30K. Therefore, the component of diffuse reflection light Lrd from intermediate transfer belt 33 is almost 0 (zero), and thus reflection light Lr includes only diffuse reflection light Lrd-K from toner 30K with the lowest reflectance and the output (output voltage) from sensor 12 attains a minimum value Vmin(d). Subsequently, in the state (state B, see FIG. 10C) at following the timing tb (see FIG. 10A), correction pattern Pd formed of toner 30A is partially exposed from correction pattern Pd formed of toner 30K. Therefore, in addition to diffuse reflection light Lrd-K from toner 30K, diffuse reflection light Lrd-A from toner 30A with higher reflectance than toner 30K is also included in reflection light Lr, and thus the output from sensor 12 increases to more than a minimum value Vmin(d). Then, in the state (state C, see FIG. 10D) at following timing tc (see FIG. 10A), correction pattern Pd formed of toner 30A is completely exposed from correction pattern Pd formed of toner 30K. In state C, intermediate transfer belt 33 is covered by correction pattern Pd formed of toner 30K, and detection light Ld is not emitted onto intermediate transfer belt 33. Therefore, in reflection light Lr, the component of diffuse reflection light Lrd-A from toner 30A with relatively high reflectance increases to more than the component in state B, and thus the output from sensor 12 has a maximum value Vmax(d). It is to be noted that the difference value between these maximum value Vmax(d) and minimum value Vmin (d) corresponds to the above-described dynamic range ΔV(d) (ΔV(d)=Vmax(d)−Vmin(d), see FIG. 10A). Therefore, the characteristic of the temporal change in the sensor output is like characteristic Gd illustrated in FIG. 10A. Image controller 134 pre-stores the timing tc at which a maximum value Vmax(d) is attained in characteristic Gd, and detects, as a correction amount for a color misregistration, a difference of timing obtained during the actual detection with respect to the timing tc (an error, see difference ΔTd illustrated by a dashed line arrow in FIG. 10A).

Figures 11A, 11B, 11C, 11D:
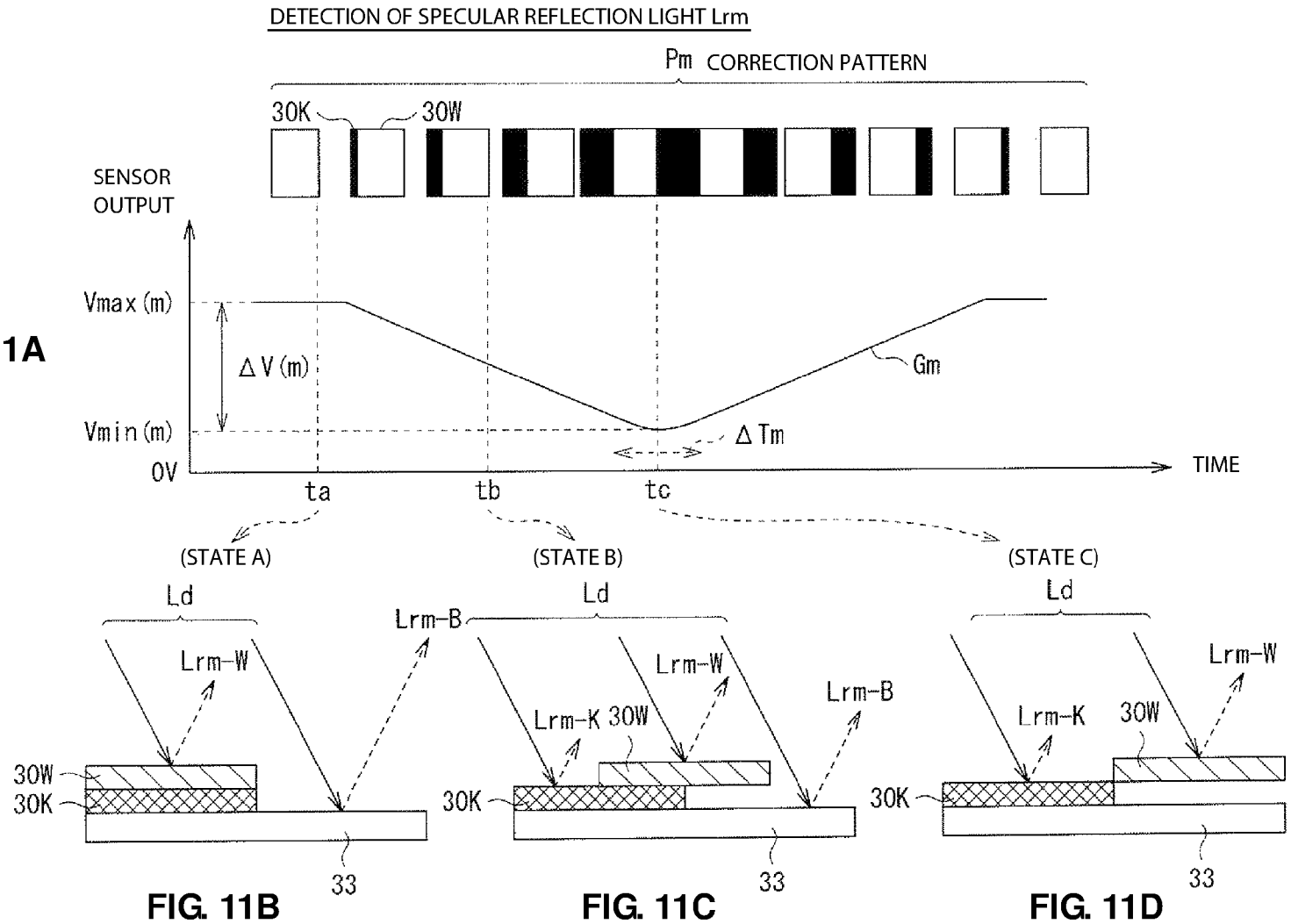
FIGS. 11A to 11D provide a timing diagram illustrating an example of a color misregistration detection operation by detecting specular reflection light.

On the other hand, as illustrated in FIGS. 11A to 11D, when the above-mentioned detection operation (timing t7 to t8) utilizing the reception of specular reflection light Lrm is performed, a color misregistration is detected utilizing the detection of the correction pattern (correction pattern Pm) of each color in the following manner. Also in this example, as illustrated in FIG. 11A, it is assumed that the correction patterns of the two colors are formed one on top of another with their relative positions shifted little by little in conveyance direction d2 on intermediate transfer belt 33. Specifically, when the detection operation utilizing the reception of specular reflection light Lrm is performed, in contrast to the case of the detection operation utilizing the reception of diffuse reflection light Lrd, the following is performed. That is, correction pattern Pd, which is formed using toner 30K, is disposed on the upper side of correction pattern Pd which is formed using toner 30K corresponding to the reference position.

In this case, the output of the sensor 12 has an inverse temporal change in contrast to the detection operation utilizing the reception of diffuse reflection light Lrd illustrated in FIGS. 10A to 10D. That is, first, in the state (state A, see FIG. 11B) at timing to (see FIG. 11A), correction pattern Pm formed of toner 30K is completely covered by correction pattern Pm formed of toner 30W. Therefore, the total component of the component of specular reflection light Lrm-B from intermediate transfer belt 33 and the component of specular reflection light Lrm-W from toner 30W with a higher reflectance than toner 30K is detected as reflection light Lr, and thus the output from sensor 12 has a maximum value Vmax(m). Subsequently, in the state (state B, see FIG. 11C) at following timing tb (see FIG. 11A), correction pattern Pm formed of toner 30K is partially exposed from correction pattern Pm formed of toner 30W. Thus, since the component of specular reflection light Lrm-K from toner 30K is smaller than the component of specular reflection light Lrm-B from intermediate transfer belt 33, the output from sensor 12 becomes less than the maximum value Vmax(m). In the state (state C, see FIG. 11D) at following timing tc (see FIG. 11A), correction pattern Pm formed of toner 30K is completely exposed from correction pattern Pm formed of toner 30W. In state C, intermediate transfer belt 33 is covered by correction pattern Pm formed of toner 30W, and detection light Ld is not emitted onto intermediate transfer belt 33. Therefore, in reflection light Lr, the component of specular reflection light Lrm-K from toner 30K with the lowest reflectance increases to more than the component in state B, and thus the output from sensor 12 attains a minimum value Vmin(m). It is to be noted that the difference value between these maximum value Vmax(m) and minimum value Vmin(m) corresponds to the above-described dynamic range ΔV(m) (ΔV(m)=Vmax(m)−Vmin (m), see FIG. 11A). Therefore, the characteristic of the temporal change in the sensor output is like characteristic Gm illustrated in FIG. 11A. Image controller 134 pre-stores timing tc at which the minimum value Vmin(m) is attained in characteristic Gm, and detects, as a correction amount for a color misregistration, a difference of timing obtained during the actual detection with respect to timing tc (an error, see difference ΔTm illustrated by a dashed line arrow in FIG. 11A).

Here, detection of the correction amount for a color misregistration is performed based on the setting (controlling) of the amount of emission of detection light Ld from sensor 12 utilizing such reflectance information 61 (according to the magnitude of the reflectance in each toner), and thus, in contrast to the above-described technique in the comparative example, the following advantages are obtained. The reason for the advantages is described in the following. That is, first, because the reflectance of toner changes according to the position of toner and the color types of toner, maximum values Vmax(d), Vmax(m), minimum values Vmin(d), Vmin(m), and the values of dynamic ranges ΔV(m), ΔV(d) also change at the time of the detection of the correction amount for a color misregistration according to those conditions. Thus, when the magnitude of the amount of emission (emission current) is uniformly set as in the technique of the comparative example, the values of dynamic ranges ΔV(m), ΔV(d) may fall below the above-described dynamic range lower limit Th depending on a combination of toners, and thus color misregistration correction may not be performed as described above. Thus, in the embodiment, as described above, the magnitude of the amount of emission is increased as needed according to the magnitude of the reflectance in each toner so that a minimum necessary reflection level is obtained (the dynamic range lower limit Th or greater is achieved) for any combination of toners. Consequently, dynamic ranges ΔV(m), ΔV(d) with a necessary magnitude are ensured regardless of the position of toner or the color types of toner, and thus in contrast to the technique in the comparative example, an advantage is achieved in that proper (accurate) execution of color misregistration correction is secured.

(Correction of Color Misregistration)

Subsequently, information processing unit 13 corrects a color misregistration in the following manner based on the thus-detected magnitude of a color misregistration (color misregistration correction amount). Print controller 135 corrects a color misregistration using the amount of emission (emission current) of detection light Ld, which is set in image controller 134. Specifically, print controller 135 performs such color misregistration correction by controlling the operation (such as a print timing) of each member in image formation section 3. At this point, a series of color misregistration correction operations in image formation apparatus 1 of the embodiment is completed.

In this manner, in the embodiment, image controller 134 identifies an image drum unit (reference position) out of image drum units 31Y, 31M, 31C, 31K, 31W that performs image formation using a toner with the lowest reflectance, by utilizing reflectance information 61. Then, print controller 135 performs color misregistration correction with respect to the thus-identified image drum unit (reference position). Specifically, for instance, in the example of the embodiment, a color misregistration is corrected in the following manner. Image controller 134 first sets the amount of emission of detection light Ld in sensor 12 for each toner in the image drum units other than the identified image drum unit by utilizing the above-described reflectance information 61, 62. Print controller 135 then uses the set amount of emission of detection light Ld to perform color misregistration correction.

Thus, for instance, even when the mounting positions of image drum units are interchanged, or an image drum unit which uses a special toner is mounted, correction of a color misregistration is applicable without changing the correction technique. Therefore, in the embodiment, it is possible to improve convenience when a color misregistration is corrected.

In addition, in the embodiment, only when determined dynamic ranges ΔV(d), ΔV(m) are greater than, or are equal to, dynamic range lower limit Th, is a color misregistration corrected, and thus proper (accurate) execution of color misregistration correction may be secured. Therefore, it is also possible to improve the accuracy of color misregistration correction.

Furthermore, in the embodiment, for the correction pattern formed by each image drum unit located on the upstream side of the identified reference position, a color misregistration is detected by utilizing the reception of diffuse reflection light Lrd. On the other hand, for the correction pattern formed by each image drum unit located on the downstream side of the reference position, a color misregistration is detected by utilizing the reception of specular reflection light Lrm. Color misregistration is detected in such a combination of upstream side or downstream side, and diffuse reflection light Lrd or specular reflection light Lrm, thereby making it possible to ensure larger dynamic ranges ΔV(d), ΔV(m) than in a reverse combination in the above-described characteristics Gd, Gm of a temporal change in the sensor output, as illustrated in FIGS. 10A to 10D and FIGS. 11A to 11D. In short, the described embodiment allows a color misregistration to be detected more easily than in a reverse combination, and enables a color misregistration to be corrected more accurately.

2. Second Embodiment

Next, a second embodiment of the invention is described. In the first embodiment, an example of a technique has been described that corrects a color misregistration utilizing reflectance information 61, 62. On the other hand, in the second embodiment below, an example of a technique is described that corrects a color misregistration utilizing color information (later-described color information 63) which indicates the color of the toner for each of image drum units 31Y, 31M, 31C, 31M, 31W. It is to be noted that in the second embodiment, the same components as in the first embodiment are labeled with the same symbols and descriptions thereof are thus omitted as necessary to avoid duplicity.

Configuration Example

First, in the embodiment, the configurations of the image formation apparatus and the information processing unit are the same as those of image formation apparatus 1 and information processing unit 13 described in the first embodiment, and thus the configurations are labeled with the same symbols and have the same descriptions.

However, in image drum units 31Y, 31M, 31C, 31M, 31W of the embodiment, instead of the above-described reflectance information 61, the color information 63 mentioned above is pre-stored in the respective tag chips 310Y, 310M, 310C, 310K, 310W. It is to be noted that color information 63 corresponds to a specific example of the "color information" in the invention.

FIG. 12 schematically illustrates an example of such color information 63. As described above, color information 63 indicates the color of the toner for each of image drum units 31Y, 31M, 31C, 31M, 31W. Specifically, color information 63 stored in tag chip 310Y in image drum unit 31Y indicates the color (yellow: Y) of toner 30Y in image drum unit 31Y. Similarly, color information 63 stored in tag chip 310M in image drum unit 31M indicates the color (magenta: M) of toner 30M in image drum unit 31M. Color information 63 stored in tag chip 310C in image drum unit 31C indicates the color (cyan: C) of toner 30C in image drum unit 31C. Color information 63 stored in tag chip 310K in image drum unit 31K indicates the color (black: K) of toner 30K in image drum unit 31K. Color information 63 stored in tag chip 310W in image drum unit 31W indicates the color (white: W) of toner 30W in image drum unit 31W.

As illustrated in FIG. 12, in this example, such color information 63 is expressed in terms of a 4-bit data (name: "T#Col"), and a number (one of the numbers "0" to "4" in this example) according to the color type of each toner mentioned above is assigned to the color. It is to be noted that in this example, the numbers "5" to "15" are unused (Reserve). Specifically, in this example, the numbers "0", "1", "2", and "4" are assigned to the color (K) of toner 30K, the color (Y) of toner 30Y, the color (M) of toner 30M, the color (C) of toner 30C, and the color (W) of toner 30W, respectively. These numbers "0" to "4" are based on the magnitude (reflection level) of the reflectance of each toner, and in this example, since the relationship in magnitude between reflectances is known, that is, "K"<"Y"≈"M"≈"C"<"W", such numbers are assigned to the colors. It is to be noted that the magnitudes of reflectances of toners 30Y, 30M, 30C are assumed to be equal to each other.

FIG. 13 schematically illustrates an example of a setting table (setting table 64A) according to the embodiment. In setting table 64A, for each of the above-described diffuse reflection (diffuse reflection light Lrd) and specular reflection (specular reflection Lrm), the amount of emission (emission currents Id, Im) of detection light Ld is specified according to the type (the number indicated by color information 63) of the color of the toner (reference toner) at the reference position described later. Specifically, in this example, emission currents Id, Im are specified for each of the cases where in case 1 the color of the reference toner is "K" (the reference toner is toner 30K), and where in case 2, the color of the reference toner is one of "Y", "M", "C", "W" (the reference toner is one of toners 30Y, 30M, 30C, 30W). In this example, in both cases, the specification is defined such that emission current Id is greater than emission current Im (Id>Im). Image controller 134 of the embodiment selects one of emission currents Id, Im pre-specified in setting table 64A utilizing the type (the number indicated by color information 63) of the color of the reference toner, thereby setting the selected one of emission currents Id, Im of detection light Ld. It is to be noted that such setting table 64A corresponds to a specific example of the "table" in the invention.

Operation and Effect

The image formation apparatus of the embodiment sets the amount of emission of detection light Ld in sensor 12 in the following manner. It is to be noted that basic operations (such as an image formation operation, a color misregistration detection operation, and a color misregistration correction operation) in the embodiment are the same as those described in the first embodiment, and thus their descriptions are omitted.

(Setting of the Amount of Emission in Sensor 12)

Figure 14:
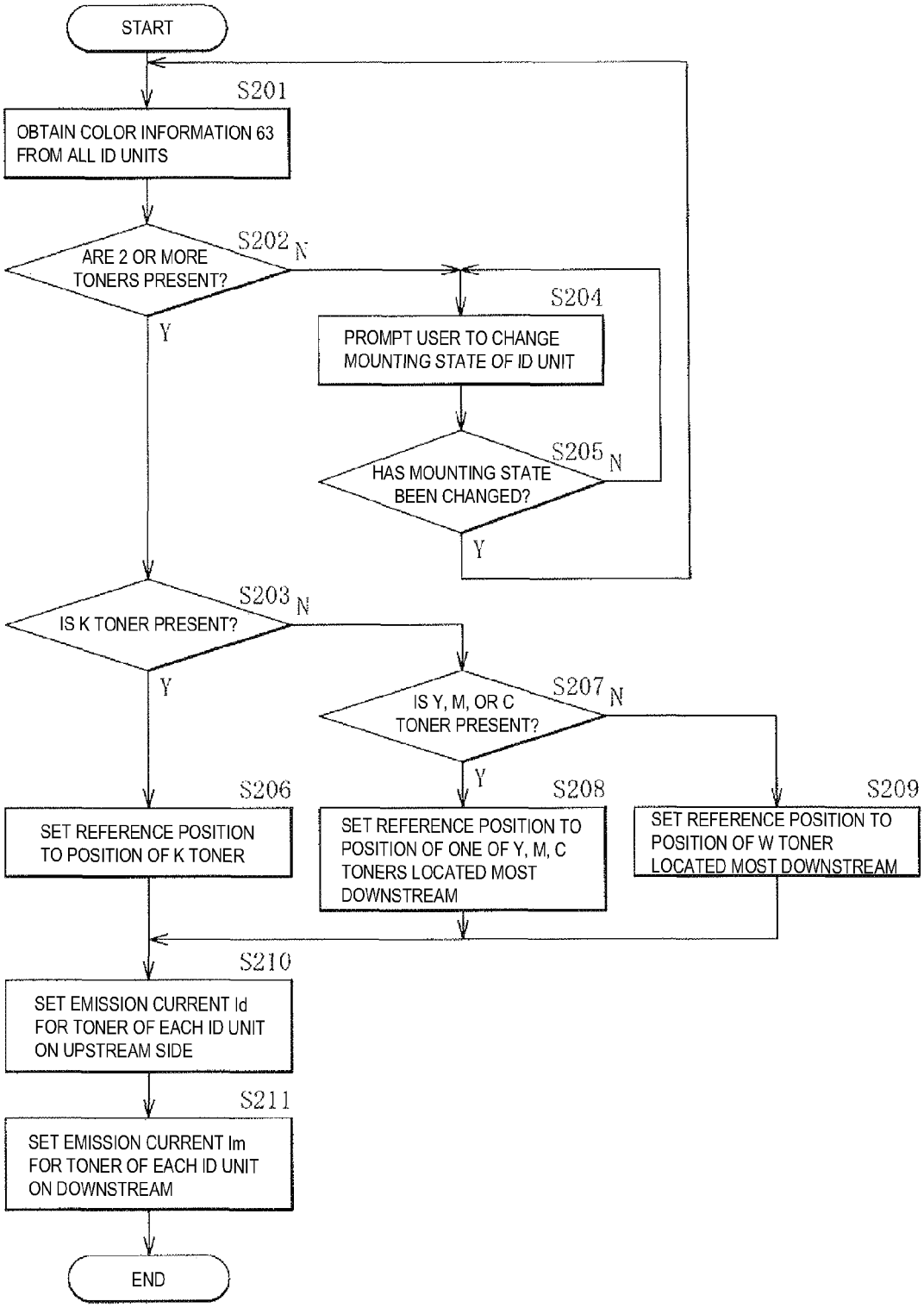
FIG. 14 is a flow chart illustrating an example of a method of setting the amount of emission according to the second embodiment.

FIG. 14 is a flow chart illustrating an example of a method of setting the amount of emission of detection light Ld according to the embodiment. In the embodiment also, before correction of a color misregistration, such setting of the amount of emission is automatically performed, which is triggered by, for instance, the start of image formation apparatus 1 or an operation such as the opening or closing of a cover in case 10.

In this method of setting the amount of emission, image controller 134 first obtains color information 63 (the number that indicates the color type of each color toner) stored in the respective tag chips 310Y, 310M, 310C, 310K, 310W from all image drum units (ID units) 31Y, 31M, 31C, 31K, 31W (step S201 of FIG. 14). Subsequently, image controller 134 utilizes the thus-obtained color information 63 to identify the mounting position of an image drum unit, as a reference position, which uses the toner with the lowest reflection level (reflectance) (steps S202 to S209).

Specifically, in this example, image controller 134 first determines whether or not the number of toner cartridges mounted on image formation apparatus 1 is two or greater (step S202). Here, when it is determined that the number of toner cartridges mounted on image formation apparatus 1 is less than two (zero or one) (N in step S202), a color misregistration may not be corrected, and the following is performed. That is, information processing unit 13 uses, for instance, the display screen of image formation apparatus 1 to prompt the user to change the mounting state of an image drum unit (step S204). Information processing unit 13 utilizes, for instance, a predetermined sensor to determine whether or not such change of the mounting state has been made by the user (step S205). When it is determined that the mounting state has not been changed yet (N in step S205), the flow returns to step S204 again. On the other hand, when it is determined that the mounting state has been changed (Y in step S205), the flow returns to step S201 described above.

On the other hand, when it is determined that the number of mounted toner cartridges is two or more (Y in step S202), image controller 134 then utilizes color information 63 to determine whether or not K toner (toner 30K) is present (step S203). Here, when it is determined that toner 30K is present (image drum unit 31K is mounted) (Y in step S203), the position (mounting position of image drum unit 31K) of toner 30K is identified as the reference position (step S206). That is, in this case, toner 30K serves as the reference toner described above.

On the other hand, when it is determined that toner 30K is not present (image drum unit 31K is not mounted) (N in step S203), image controller 134 then makes the following determination. That is, image controller 134 determines whether or not at least one of Y toner (toner 30Y), M toner (toner 30M), and C toner (toner 30C) is present (step S207). Here, when it is determined that at least one of toners 30Y, 30M, 30C is present (at least one of image drum units 31Y, 31M, 31C is mounted) (Y in step S207), the following is performed. That is, image controller 134 identifies the position (mounting position of the relevant image drum unit) of one of these toners 30Y, 30M, 30C located the most downstream as the reference position (step S208). That is, in this case, the toner (one of toners 30Y, 30M, 30C) located the most downstream serves as the reference toner described above.

On the other hand, when it is determined that none of toners 30Y, 30M, 30C is present (none of image drum units 31Y, 31M, 31C is mounted) (N in step S207), the following is performed. That is, in this case, image controller 134 identifies the position (mounting position of image drum unit 31W) of toner 30W located the most downstream out of two or more toners present as the reference position (step S209). That is, toner 30W serves as the reference toner described above.

In this manner, the mounting position of an image drum unit, which uses the toner with the lowest reflection level (reflectance), is identified (the reference toner is identified) as the reference position by utilizing color information 63, and the flow proceeds to following steps S210, S211.

That is, image controller 134 first sets emission current Id of detection light Ld in sensor 12 for the toner of each image drum unit located on the upstream side of the identified reference position by using, for instance, setting table 64A illustrated in FIG. 13 (step S210). Subsequently, image controller 134 sets emission current Im of detection light Ld in sensor 12 for the toner of each image drum unit located on the downstream side of the identified reference position by using, for instance, setting table 64A illustrated in FIG. 13 (step S211). At this point, a series of processing in the method of setting the amount of emission of detection light Ld illustrated in FIG. 14 is completed.

As described above, also in the embodiment, it is basically possible to obtain similar effects by the operations similar to those of the first embodiment. That is, it is possible to improve convenience when a color misregistration is corrected.

Particularly, in the embodiment, a color misregistration correction operation (particularly, the setting of the amount of emission of detection light Ld) is performed using color information 63, and thus the following effect is also obtainable. That is, for instance when a toner with a known (relationship in the magnitude of) reflectance, such as toners 30Y, 30M, 30C, 30K, 30W is used, it is possible to obtain similar effects to those of the first embodiment without pre-storing specific information on reflectance of the toners in respective tag chips 310Y, 310M, 310C, 310K, 310W.

3. Modification

Next, a modification in common with the first and second embodiments is described. In each of the first and second embodiments, an image formation apparatus using a so-called intermediate transfer method has been described as an example. On the other hand, in the modification, an example of its application to an image formation apparatus using a so-called direct transfer system is described, with the image formation apparatus allowing a toner image to be directly transferred to print medium 9 without happening via the above-described intermediate transfer belt unit. That is, in the first and second embodiments, intermediate transfer belt 33 corresponds to a specific example of the "transfer object" in the invention, whereas in the modification, the below-described transfer belt 37 or print medium 9 themselves each correspond to a specific example of the "transfer object" in the invention. It is to be noted that in the modification, the same components as in the first and second embodiments are labeled with the same symbols and descriptions thereof are omitted as necessary to avoid duplicity.

Configuration Example

Figure 15:
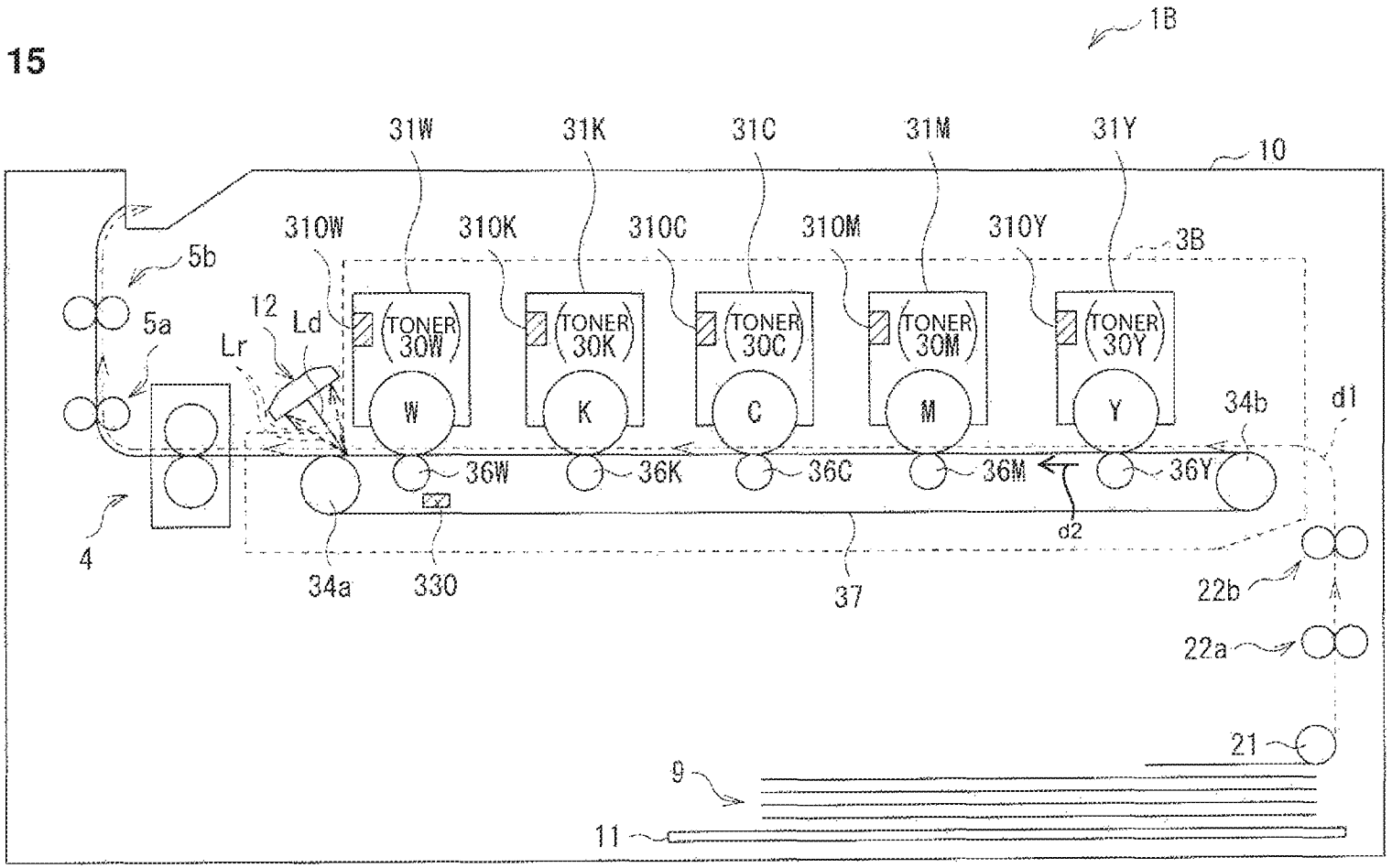
FIG. 15 is a schematic diagram illustrating an overall configuration example of an image formation apparatus according to a modification.

FIG. 15 schematically illustrates an overall configuration example of an image formation apparatus (image formation apparatus 1B) according to the modification. Image formation apparatus 1B also functions as a printer (a color printer in this example) that forms an image (a color image in this example) on print medium 9 using electrophotography. However, image formation apparatus 1B is an image formation apparatus using the so-called direct transfer system as described above. It is to be noted that image formation apparatus 1B also corresponds to a specific example of the "image formation apparatus" in the invention.

As illustrated in FIG. 15, image formation apparatus 1B includes paper sheet cassette 11, supply roller 21, conveyance rollers 22*a*, 22*b*, image formation section 3B, sensor 12, fixture unit 4, and discharge rollers 5*a*, 5*b*. As illustrated in FIG. 15, each of these members is housed in a predetermined case 10.

In this example, as illustrated in FIG. 15, image formation section 3B has five image drum units (image formation units) 31Y, 31M, 31C, 31K, 31W, five transfer rollers 36Y, 36M, 36C, 36K, 36W, transfer belt (conveyance belt) 37, and two drive rollers 34*a*, 34*b*.

As also illustrated in FIG. 15, image drum units 31Y, 31M, 31C, 31K, 31W are disposed in series in conveyance direction (conveyance path) d1 of print medium 9. Specifically, the image drum units 31Y, 31M, 31C, 31K, 31W are disposed in the order of image drum units 31Y, 31M, 31C, 31K, 31W in conveyance direction d1 (from the upstream side to the downstream side). It is to be noted that tag chips 310Y, 310M, 310C, 310K, 310W, described above, are mounted on image drum units 31Y, 31M, 31C, 31K, 31W, respectively. Also, in the modification, conveyance direction d1 mentioned above corresponds to a specific example of the "conveyance direction" in the invention.

Transfer belt 37 is a belt for conveying print medium 9 in conveyance direction d1. As illustrated in FIG. 15, transfer belt 37 is driven so as to move rotationally by drive rollers 34*a*, 34*b* in conveyance direction d2. Such transfer belt 37 corresponds to a specific example of the "conveyance member for a print medium" in the invention. It is to be noted that transfer belt 37 is provided with tag chip 330 described above.

Transfer rollers 36Y, 36M, 36C, 36K, 36W are each a member for electrostatically transferring each color toner image formed in image drum units 31Y, 31M, 31C, 31K, 31W onto print medium 9. As illustrated in FIG. 15, transfer rollers 36Y, 36M, 36C, 36K, 36W are disposed opposite to image drum units 31Y, 31M, 31C, 31K, 31W, respectively, with transfer belt 37 interposed therebetween.

In the modification, sensor 12 is a device that emits detection light Ld onto transfer belt 37 or print medium 9, and receives its reflection light (reflection light Lr). Specifically, sensor 12 is designed to detect a "color misregistration" by utilizing such emission of detection light Ld to the correction pattern on transfer belt 37 or print medium 9, and reception of reflection light Lr from transfer belt 37 or print medium 9. That is, the "color misregistration" in the modification refers to the phenomenon in which the formation positions of color toner images formed on transfer belt 37 or print medium 9 vary among the colors (relative misalignment).

Operation and Effect

With image formation apparatus 1B in such a configuration, it is basically possible to obtain similar effects by the operations similar to those of the first and second embodiments. That is, it is possible to improve convenience when a color misregistration is corrected.

4. Other Modifications

Although the invention has been described by way of the embodiments and modification so far, the invention is not limited to those embodiments and various modifications may be made.

For instance, in the aforementioned embodiments, the configurations (such as the shape, arrangement, number) of the members in the image formation apparatus have been specifically described. However, the configurations of the members are not limited to what has been described in the embodiments, and other shapes, arrangements, numbers are applicable. Also, the values of various parameters and their relationships in magnitude described in the embodiments are not limited to what has been described in the embodiments, and other values and relationships in magnitude are also applicable.

Also, in the aforementioned embodiments, exemplary techniques for the setting of the amount of emission of detection light Ld, the detection of color misregistration and the correction of color misregistration in sensor 12 have been specifically described. However, those techniques are not limited to what has been described in the embodiments, and other techniques may be used.

Furthermore, in the aforementioned embodiments, the case where five image drum units (image formation units) are provided (image drum units 31Y, 31M, 31C, 31K, 31W) has been described as an example. However, the invention is not limited to this. That is, as long as (two or more) image formation units, which form each color toner image and each color correction pattern using toners of different colors, are provided, the configuration may be as below. That is, for instance, the number of image formation units that form toner images, the combination of colors of the toner used for the toner images, and the order of the formation (order of arrangement of the image formation units) of color toner images, may be set in any way according to the application and purpose.

In addition, the series of processing described in the aforementioned embodiments may be performed by hardware (circuit) or by software (program). When the series of processing is performed by software, the software includes a group of programs for executing each of the functions by a computer. For instance, each of the programs may be pre-installed in the computer to be used or may be installed in the computer via a network or a recording medium to be used.

In the aforementioned embodiments, an image formation apparatus (printer) having a printing function has been described as a specific example of the "image formation apparatus" in the invention. However, the invention is not limited to this. That is, in addition to the image formation apparatus having such a printing function, the invention is applicable as well to an image formation apparatus (a copy machine and a facsimile) having, for instance, a scanning function and a facsimile function, and an image formation apparatus (multifunction machine) having those functions in a multiple manner.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

image formation units mounted in series in a conveyance direction of a transfer object and configured to form developer images of respectively different color developers and correction patterns of the different color developers on the transfer object;

a sensor that detects a color misregistration which is a variation in a formation position of the developer images on the transfer object between the colors, by an emission of a detection light to the correction pattern on the transfer object and a reception of a reflection light from the transfer object;

an identification unit that identifies, out of the image formation units, a first image formation unit which performs the image formation using a first developer with a lowest reflectance, based on reflectance information indicating reflectances of the developers for the image formation units, or color information indicating the colors of the developers for the image formation units; and a corrector that corrects the color misregistration with respect to the first image formation unit identified by the identification unit.

2. The image formation apparatus according to claim 1, wherein the sensor receives a diffuse reflection light and a specular reflection light as the reflection light.

3. The image formation apparatus according to claim 2, wherein provided that a second image formation unit denotes each of the image formation units other than the first image formation unit, and a second developer denotes the developer in the second image formation unit, the sensor detects the color misregistration in the correction pattern formed by the second image formation unit located on an upstream side of the first image formation unit in the conveyance direction, by utilizing the reception of the diffuse reflection light, and detects the color misregistration in the correction pattern formed by the second image formation unit located on a downstream side of the first image formation unit in the conveyance direction, by utilizing the reception of the specular reflection light.

4. The image formation apparatus according to claim 3, wherein for the detection of the color misregistration by utilizing the reception of the diffuse reflection light, the correction pattern formed by using the first developer is disposed on top of the correction pattern formed by using the second developer, and for the detection of the color misregistration by utilizing the reception of the specular reflection light, the correction pattern formed by using the second developer is disposed on top of the correction pattern formed by using the first developer.

5. The image formation apparatus according to claim 1, further comprising a setting unit that sets an amount of emission of the detection light in the sensor for each second developer by utilizing the reflectance information or the color information, the second developer being each of the developers in one or more second image formation units other than the first image formation unit out of the image formation units, wherein the corrector corrects the color misregistration by using the amount of emission of the detection light set by the setting unit.

6. The image formation apparatus according to claim 5, wherein the setting unit selects one of an amounts of emission of the detection light pre-specified in a predetermined table by utilizing the reflectance information or the color information, thereby setting the amount of emission of the detection light.

7. The image formation apparatus according to claim 6, wherein the table specifies each of the amounts of emission of the detection light according to a magnitude of a maximum light amount of the reflection light or a color type of the first developer.

8. The image formation apparatus according to claim 5, wherein when the setting unit utilizes the reflectance information to set the amount of emission of the detection light, the setting unit additionally utilizes information indicating a reflectance of the transfer object to set the amount of emission of the detection light.

9. The image formation apparatus according to claim 8, further comprising a derivation unit that derives a dynamic range by utilizing the reflectance information and the information indicating the reflectance of the transfer object, the dynamic range corresponding to a difference value between a maximum light amount of the reflection light and a minimum light amount of the reflection light, wherein when the dynamic range determined by the derivation unit is greater than or equal to a threshold value, the corrector corrects the color misregistration.

10. The image formation apparatus according to claim 1, wherein when the identification unit uses the color information to identify the first image formation unit, the identification unit identifies one of the image formation units that performs the image formation using a black developer as the first image formation unit.

11. The image formation apparatus according to claim 1, wherein one of the reflectance information and the color information is pre-stored in each of the image formation units.

12. The image formation apparatus according to claim 1, wherein the transfer object is one of a conveyance member for the developer image and the correction pattern, a conveyance member for a print medium, and a print medium.

13. An information processing device comprising:

an identification unit that identifies, out of image formation units mounted in series in a conveyance direction of a transfer object and configured to form developer images of developers of respectively different color developers and correction patterns of the different color developers on the transfer object, a first image formation unit that performs image formation using a first developer having a lowest reflectance, based on reflectance information indicating reflectances of the developers for the image formation units or color information indicating the colors of the developers for the image formation units; and a corrector that corrects a color misregistration, which is a variation in formation position of the developer image on the transfer object between the colors, with respect to the first image formation unit identified by the identification unit.

* * * * *